United States Patent [19]

Ovard

[11] 4,020,130

[45] Apr. 26, 1977

[54] SPLASH BAR FOR COOLING TOWER FILL ASSEMBLY

[76] Inventor: John C. Ovard, 3465 Ridgeview Drive, Santa Rosa, Calif. 95405

[22] Filed: Aug. 21, 1975

[21] Appl. No.: 606,031

[52] U.S. Cl. ..... 261/111; 261/DIG. 11

[51] Int. Cl.[2] ..... F28C 1/00

[58] Field of Search ..... 261/111–113, 261/DIG. 11

[56] References Cited

UNITED STATES PATENTS

| | | | |
|---|---|---|---|
| 2,497,389 | 2/1950 | Ahrens | 261/111 |
| 3,389,895 | 6/1968 | De Flon | 261/111 |
| 3,468,521 | 9/1969 | Furlong et al. | 261/111 |
| 3,647,191 | 3/1972 | Fordyce | 261/111 |
| 3,749,381 | 7/1973 | Furlong et al. | 261/111 |
| 3,758,088 | 9/1973 | Fordyce | 261/111 |

*Primary Examiner*—Frank W. Lutter
*Assistant Examiner*—William A. Cuchlinski, Jr.
*Attorney, Agent, or Firm*—Michael C. Sudol, Jr.; J. Jerome Behan

[57] ABSTRACT

A splash bar for a cooling tower fill assembly is of longitudinally Z-shaped configuration. The top and bottom of the bar are parallel and are connected by an essentially vertical surface. The entire bar has openings throughout.

7 Claims, 9 Drawing Figures

SPLASH BAR FOR COOLING TOWER FILL ASSEMBLY

BACKGROUND OF THE INVENTION

The invention relates to an improved splash bar cooling tower fill configuration for use particularly in cross-flow cooling towers, of either the mechanical draft (which is illustrated herein) or natural draft, i.e., hyperbolic type.

Among the problems associated with prior splash bar fill configurations and arrangements is that in most designs the splash bars are disposed with the longitudinal axis perpendicular to the direction of air flow. The transverse shape and dimensions of these splash bars thus create a large projected area in the direction of air flow which results in a higher resistance to air flow. Consequently the pressure drop induced in the system by the splash bars is greater than desired. Furthermore, fill splash bars designed for transverse orientation must of necessity have a low profile transverse shape thereby resulting in a part with less structural strength and stability than desired.

Typical examples of this type of fill are shown in U.S. Pat. No. 3,647,191 patented on Mar 7, 1972, U.S. Pat. No. 3,338,895 patented on June 25, 1968 and U.S. Pat. No. 3,468,521 patented on Sept. 23, 1969.

U.S. Pat. No. 3,647,191 shows M-shaped open base fill lying transverse to air flow namely lying essentially perpendicular to the air flow direction. U.S. Pat. No. 3,338,895 shows a triangular open base fill again lying transverse or perpendicular to the air flow. U.S. Pat. No. 3,468,521 shows a fill strip having an elongated edge that is convex in vertical lateral planes and an upper surface which slopes downwardly to terminate at the convex portion. Again, this fill lies transverse or perpendicular to air flow.

Other splash bar fill designs which orient the members such that the longitudinal axis of said splash bar fill are parallel to the direction of air flow do not provide an effective splash surface area in the direction of water flow and the water break-up and retention time are less than desired. As an example, U.S. Pat. No. 3,758,088 patented on Sept. 11, 1973 shows non-planar sine-wave type fill members lying longitudinally and parallel with the air flow. This fill is made of solid sine-wave sheets having no openings therein for effective water break-up and more efficient heat transfer between water and air.

Also older designs such as wood fill slats oriented with the longitudinal axis parallel to air flow as in U.S. Pat. No. 2,497,389 patented Feb. 14, 1950 to R. H. Ahrens did not materially aid in directing and controlling air flow in the desired direction and performance of the cooling tower was adversely affected when cross winds or other atmospheric disturbances occurred.

SUMMARY OF THE INVENTION

This invention relates to improvements in splash bar fill for a crossflow cooling tower fill assembly. Accordingly an object of this invention is to provide a splash bar fill configuration that provides minimum resistance to air flow and that directs the air flow in the intended path parallel to the splash bar axis in a horizontal plane through the fill assembly area and which maintains improved performance, particularly the ability to break-up the falling liquid into droplets and to impede the fall of these liquid droplets within the heat transfer or fill assembly area. A further improvement is the ability to maintain a high heat transfer efficiency when cross winds and other atmospheric distrubances are present.

An important object of this invention is to provide a splash bar fill configuration that generates a maximum amount of liquid surface area in direct contact with air by breaking up the water into smaller drops by means of direct splashing of water on the solid surface portion of the splash bar, additionally, by creating a liquid film on the solid portion of the splash bar and by creating additional droplets through mechanical break-up of water as large drops hit the perforated surface and these larger drops are sheared into smaller drops as they pass through the perforations.

Another object of this invention is to provide a fill configuration which increases the time it takes for water to fall to the bottom of the tower, i.e., by increasing the retention time.

Another object of this invention is to provide a splash bar fill configuration with increased structural strength and stability such that when hanging in a holding grid the splash bar is held firmly in place and supported in all directions and which also provides increased bearing support on the lower surface.

Finally, an object of this invention is to provide a splash bar fill assembly configuration for crossflow cooling towers which is simple and economical to construct and has increased structural strength because of its shape and has a long life in the type of cooling towers described.

IN THE DRAWINGS

Figure 1:
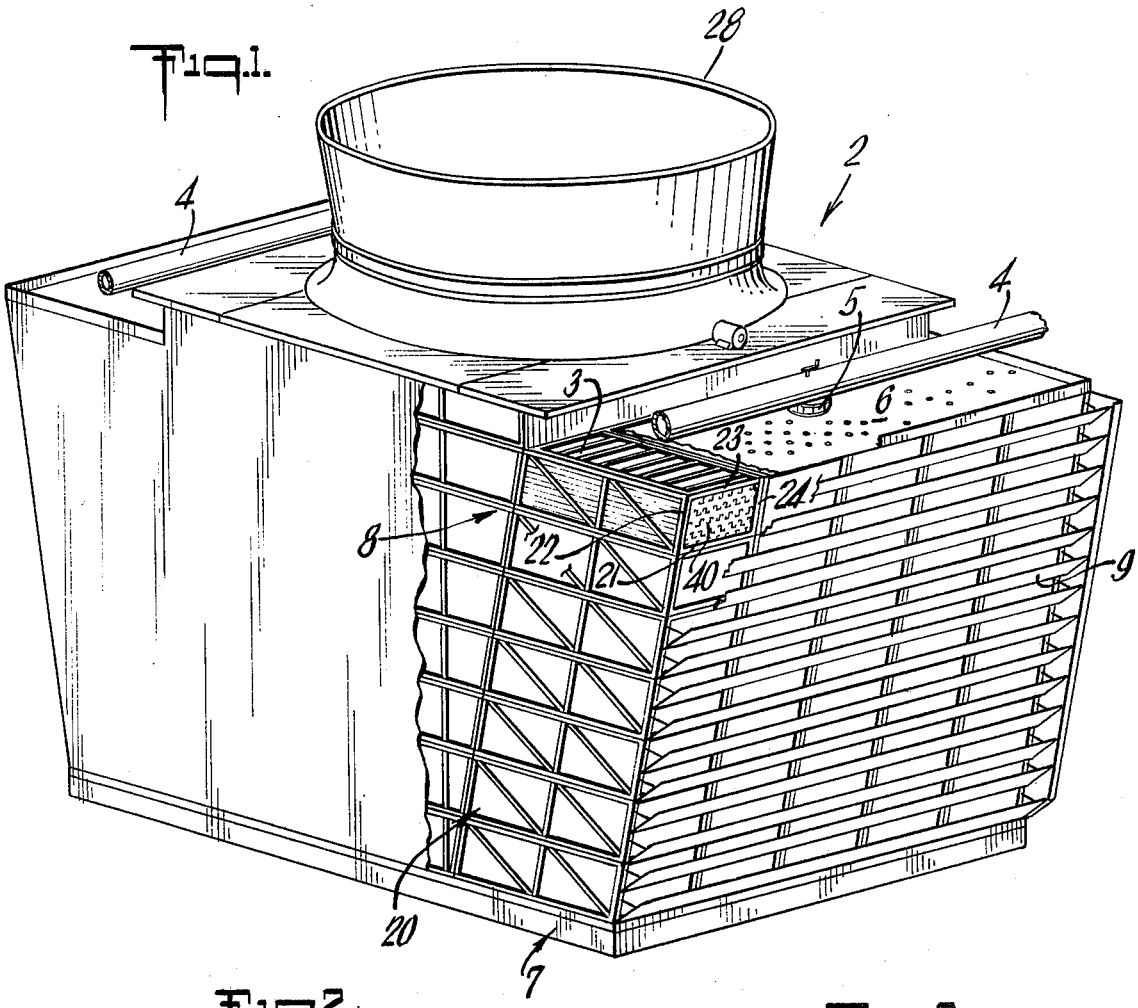
FIG. 1 is an isometric view of a typical cross-flow cooling tower.

An induced draft crossflow water cooling tower 2 is illustrated in FIG. 1 having two sides enclosed and two sides open, the open sides representing the air intake area. Louvers 9 are incorporated in the air intake sides to prevent water splash from the fill assembly area shown generally as 3 and to reduce wind effects on performance. The cooling tower 2 has the usual hot water inlet 4, distributor valve 5 and hot water basin 6 having holes or other distribution means therein through which the water is dispersed into the fill assembly or heat transfer area. A cold water basin shown generally as 7 is located beneath the fill assembly 3. Mist eliminators shown generally as 8 are located behind the fill section to strip water from the moisture laden air prior to its exit from the cooling tower. Air flow is induced by a fan (which is not shown) but which draws air upwardly and outwardly through the fan cylinder 28. The fan assembly is supported by various frame members of the tower 2 and is conventional.

Figure 2:
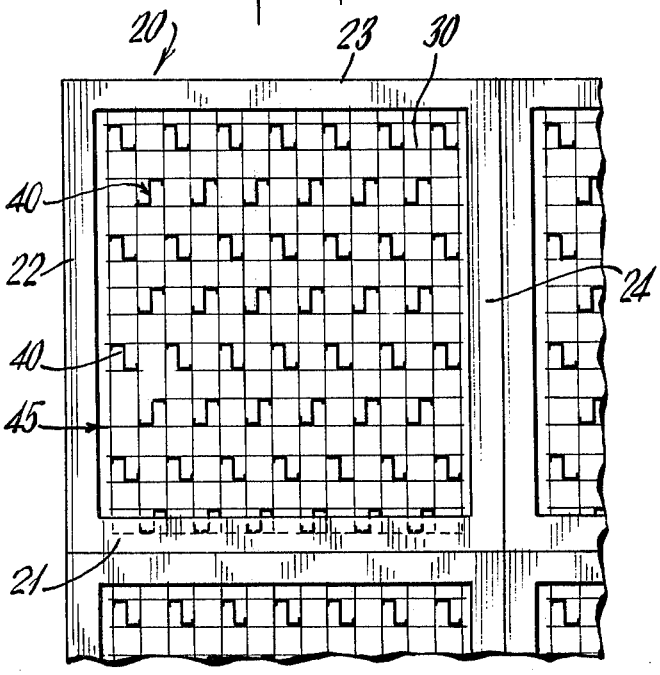
FIG. 2 is an end view of a portion of the fill assembly area showing the fill and fill hangers therein.

As shown in FIG. 2, the entire fill assembly structure 3 can be a series of frames or boxlike units having sides 24 top and bottom members 23 and 21 and longitudinal sides 22. The fill hangs in the frame as shown in FIG. 1.

A plurality of grids shown as 32 and 33 spaced from one another and disposed in vertical planes can be hung from the upper end of each frame member 23. Each of these grids 30 comprise a number of horizontal elements 33 and intersecting generally vertical elements 32 to form a holding structure for the fill elements 40, 54 or 64. The horizontal and vertical elements 33 and 32 of a grid structure are composed of either a synthetic resin material such as plastic or can be of a metal such as steel or fine drawn wire material. The grid elements can be hung from the upper frame member 23 by conventional means such as for example by J-hooks or bolts or by having the grids rest in notched members and other conventional methods well known to those skilled in the art.

A plurality of splash bars 40, 54 or 64 rest on and are supported by the horizontal elements 33 of the grid structure 30. Any number of grid structures 30 can be installed at various intervals along the length of the fill members and enough grid structures should be installed so that sufficient support is given the individual fill elements to prevent sagging. For example in FIG. 4, three grid structures 30 are shown supporting fill member 40.

A typical longitudinal fill member 40 of the invention is shown in detail in FIGS. 4 and 5–7 where it may be seen that the splash bar 40 is elongated and is constructed with a Z-type cross section. Other type fill members falling within the instant invention are shown in FIGS. 8 and 9.

Figures 4, 5, 6, 7, 8, 9:
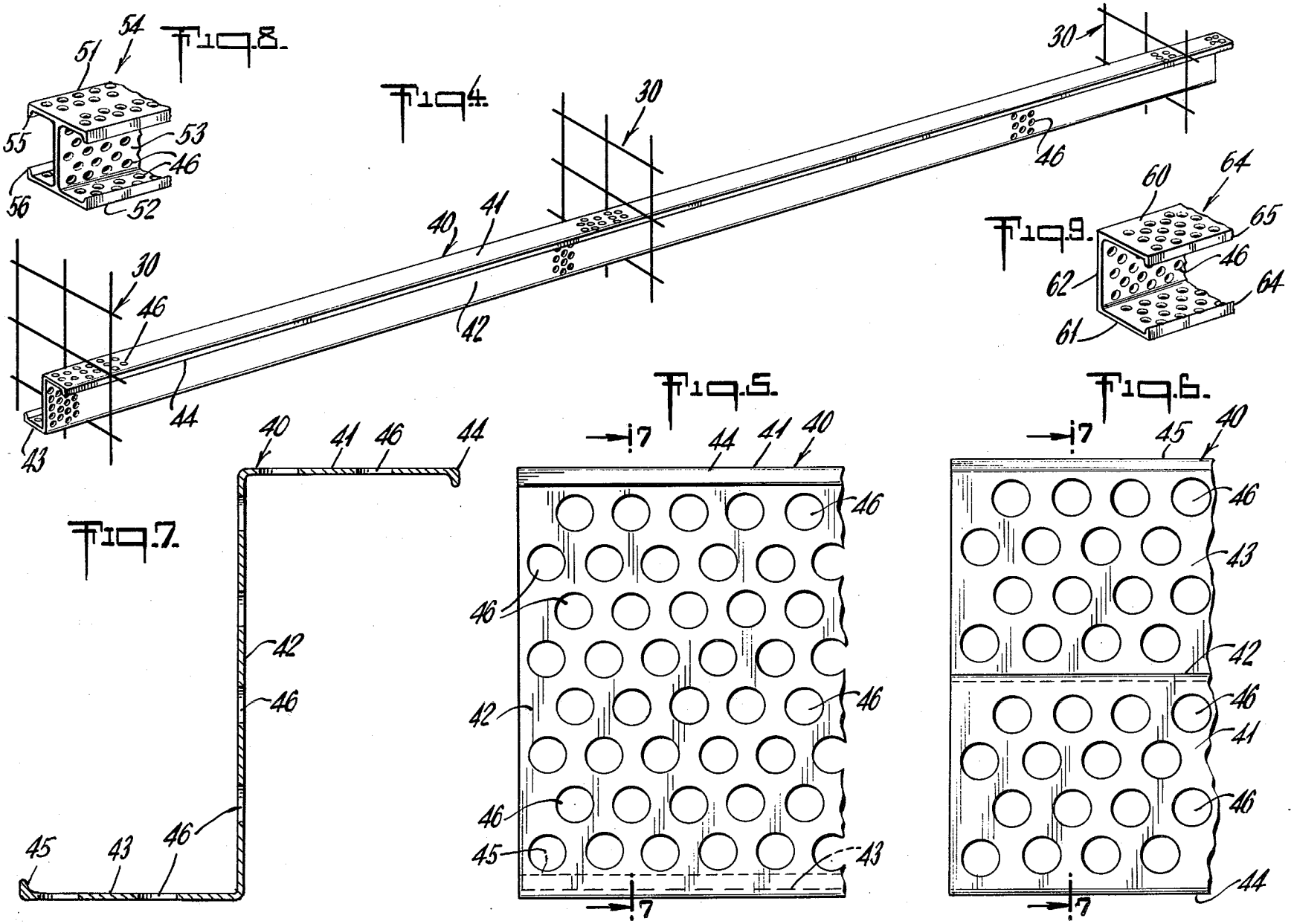
FIG. 4 is an isometric view of one type longitudinal splash bar fill member.
FIG. 5 is a side view of a portion of one type splash bar fill member.
FIG. 6 is a top view of a portion of a one type of splash bar fill member of this invention.
FIG. 7 is a cross sectional view of the splash bar fill configuration taken along 7—7 of FIGS. 5 and 6.
FIG. 8 is an isometric view of another type of splash bar fill member of this invention.
FIG. 9 is an isometric view of yet another type of a splash bar fill member of this invention.

As viewed in transverse or end section in FIG. 7 the so-called Z-bar consists essentially of a horizontal top surface element 41 and a horizontal lower surface element 43. These elements are connected together by an essentially vertical element 42. The ends of the top surface element 41 and bottom surface element 46 can terminate in a small lip or projection 44 and 45 respectively to provide additional lateral stability in the grid. The entire surface of the elongated splash bar fill member 41 is perforated with openings 46. These openings are shown in the figures as round holes but they can also be square, rectangular, oblong or polygonal. It is important that these openings be large enough to prevent the water from filming over the opening thereby impeding water flow and at the same time they must be small enough to disperse the greatest number of falling drops or water streams into smaller drops. Preferably if round openings are employed the diameter of these openings should vary from ⅛ inch (3.17 m.m.) to ¾ inch (19.05 m.m.), preferably to ½ inch (12.70 m.m.) but most preferably it has been found that openings from 3/16 inch (4.765 m.m.) to 5/16 inch (7.935 m.m.) in diameter bring about a good liquid mechanical breakup and splashing action rather than filming action. In the present invention, the open area of the perforated portion of the fill area should be from 10% to 80% for maximum effectiveness.

Applicants have also discovered that the best operating conditions are obtained when dimensions of the upper surface area 41 and lower surface 43 are about equal in width. It has also been discovered that the width of upper surface 41 and lower surface 43 together should be about equal to the width of connecting surface 42 for optimum conditions. Those skilled in the art will realize that the connecting surface 42 although being called a Z-shape can generally be in either a vertical position as shown in FIG. 7, on a slight incline to the vertical and even in a literal Z-shape configuration. The upper surfaces 41 and 43 however are generally horizontal for best results. The splash bar fill member 40, 54 and 64 can be formed from any rigid material such as thin metal but preferably from a synthetic resin sheet material.

The lower surface 43 of a particular fill member acts as a foot for support of the member particularly when the surface 43 is resting on a horizontal grid 33. It is preferable that the grid structure 30 is of such a rectangular shape that the lip or projection 44 of the upper surface 41 and lip or projection 45 of lower surface 43 are supported and rest against the vertical grid members 32 in each particular rectangular shape. This would allow the fill member 40, 54 or 64 to be snugly inserted in a grid pattern and this will achieve essentially vertical, horizontal and lateral structural stability to the fill member. It will also provide good bearing support on the lower surface since the entire length of the lower surface 43 rests on the horizontal member 33, i.e, there is no edge or pointed support resting on the horizontal member 33 which would tend to abrade or wear out the part at the support point or surface after prolonged use.

In the preferred embodiment the surface of the Z-shaped bar are flat as shown in FIG. 7. However, one skilled in the art would appreciate that these surfaces may be slightly curved, corrugated or even slightly V-shaped provided that the dimensions of such variations are generally small in relation to the overall dimensions of the splash bar.

The particular configurations of fill members shown in FIG. 8 and FIG. 9 would be encompassed by this invention also. In FIG. 8 is shown a type of I-beam fill 54 having substantially horizontal members 51 and 52 and a substantially vertical member 53 connecting the two horizontal members. These fill members 54 can also have lips or projections on the top and bottom surfaces 55 and 56 as shown for better support in the grid as previously described for the Z-shape fill. Similarly in FIG. 9 is shown another type of fill 64 having horizontal members 60 and 61 and substantially vertical connecting member 62 at one end. The vertical connecting member can be anywhere between the horizontal members 60 and 61 for example it can be on the extreme right side of the top and bottom horizontal members. These fill members also have lips or projections 65 and 66 at the top and bottom surfaces as shown.

All of the comments concerning the Z-bar fill described above would apply equally to the fill 54 and 64 shown in FIGS. 8 and 9.

The fill bars 40, 54 and 64 resting in the grid patterns 30 lie with their longitudinal axis essentially parallel to the air flow direction in a crossflow cooling tower, thus as this can be seen in FIG. 2, the air flow would be directly into the drawing. The splash bars 40, 54 and 64 and holding grid structure 30 as shown present little resistance to the air flow, however, the grid structure does provide support and restraint of the splash bar fill described in the transverse and vertical direction.

Also, since the individual fill pieces 40, 54 or 64 lie with their longitudinal axis parallel with air flow, the plurality of fill pieces dispersed in the grid structure direct the air flow in its intended path, namely parallel to the splash bars longitudinal axis and also have a tendency to direct the air in horizintal plane through the fill assembly area. This construction aids in improving the performance when cross winds or other atmospheric disturbances are present. Similarly, because of the substantially vertical connecting surfaces 42, 53 and 62, the fill bars are still able to break up water droplets should there be cross winds. If the splash bars were not so oriented, cross winds and other atmospheric disturbances would reduce the efficiency of the cooling tower.

Figure 3:
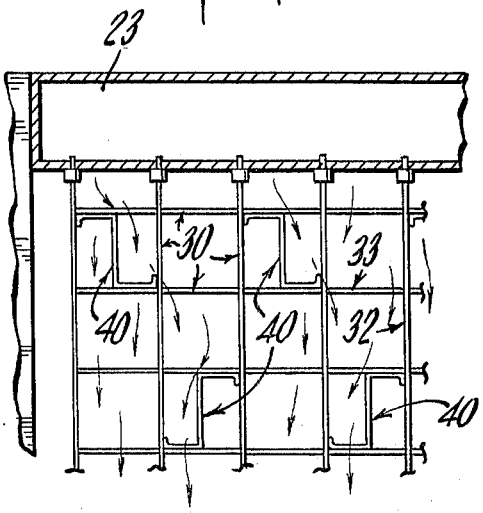
FIG. 3 is an exploded fragmentary view of the wire grid and fill members lying therein.

As can be seen from FIGS. 2 and 3, the individual fill pieces can be placed in a staggered pattern. Thus, each fill member 40 and, also 54 or 64 although these are not shown in FIGS. 2 and 3, is located in every other horizontal space defined by individual horizontal 33 and vertical 32 grids in the grid structure 30 but are vertically offset to adjacent fill members therebelow and immediately above so that the water directed onto a row of fill pieces 45 as shown in FIG. 2 must follow a torturous or often oblique path before reaching the cold water basin 7 as those skilled in the art would recognize. The staggered pattern represents a preferred embodiment of the invention and it should be realized that the fill can be placed in the grid one atop each other with spaces next to each piece or for that matter every opening in the grid structure 30 can be filled with a fill member.

It should be understood, of course, that the foregoing disclosure relates only to a preferred embodiment of the invention for crossflow cooling towers and that numerous modifications or alterations may be made therein without departing from the spirit and scope of the invention as set forth in the appended claims.

What is claimed is:

1. For use with a crossflow water cooling tower having a hot water distributor for distributing water onto the splash type fill assembly structure, a cold water basin and means for inducing crossflow movement of air therebetween, a combination therewith of splash type fill assembly structure comprising, a series of elongated generally horizontal fill members;

means supporting the fill members in the space between the hot water distributor and said cold water basin in horizontal and vertical spaced relationship;

said fill members having their longitudinal axis generally parallel with the direction of air flow and said fill members having a substantially flat elongated upper surface element, a substantially flat elongated lower surface element and a connecting elongated substantially vertical surface element, said upper and lower surface elements being substantially parallel to each other and all of said surface elements being perforated throughout for passage and dispersal of liquid falling thereon.

2. A splash type fill assembly structure as set forth in claim 1 wherein said means for supporting the fill members comprises a plurality of upright and horizontal grids located in planes generally perpendicular to the path of crossflowing air, said grids snugly encompassing a fill member.

3. The splash type fill assembly structure of claim 2 wherein the upper surface element and bottom surface element are substantially the same width as the distance between two adjacent upright grids and the connecting surface element is located anywhere along the width of the upper or lower surface elements.

4. A splash type fill assembly structure of claim 1 wherein said fill members are in relative offset relationship in said supporting means with respect to fill members thereabove or therebelow.

5. A splash type fill assembly structure of claim 1 wherein the perforations in all the surfaces are holes from ⅛ inch to ½ inch in diameter and are 10% to 80% of the projected surface area of each fill member.

6. The splash type fill assembly structure of claim 1 wherein said upper surface element extends in an opposite direction from the connecting surface element than does the lower surface element and the width of the upper surface element is substantially the same as the width of the lower surface element.

7. The splash type fill assembly structure of claim 1 wherein said upper surface element extends in an opposite direction from the connecting surface element than does the lower surface element, the width of the upper surface element being substantially the same as the width of the lower surface element and the width of the connecting surface element being about equal to the combined width of the upper and lower surface elements.

* * * * *